United States Patent [19]

Nguyen et al.

[11] Patent Number: 5,022,166

[45] Date of Patent: Jun. 11, 1991

[54] FLUTTER SUPPRESSION AIR FOILS

[75] Inventors: Dong D. Nguyen; Marvin L. Harris, both of Lawrenceville, N.J.

[73] Assignee: Union Camp Corporation, Wayne, N.J.

[21] Appl. No.: 534,798

[22] Filed: Jun. 7, 1990

[51] Int. Cl.[5] ..... F26B 13/20

[52] U.S. Cl. ..... 34/120; 226/97

[58] Field of Search ..... 34/155, 156, 158, 16, 34/18, 23, 117, 122, 120; 226/97

[56] References Cited

U.S. PATENT DOCUMENTS 2,574,083 11/1951 Andrews ..... 34/158
3,198,499 8/1965 Stanley ..... 263/3
4,145,796 3/1979 Mair ..... 26/98
4,306,358 12/1981 King, Jr. ..... 34/23

*Primary Examiner*—Henry Bennett
*Attorney, Agent, or Firm*—Edward J. Sites

[57] ABSTRACT

Apparatus and methods for reducing the amplitude and frequency of web-edge flutter associated with drawing web materials are provided. The apparatus includes a pair of air foils disposed proximate to a pair of opposing planar surfaces of the web. Each of the air foils includes a first convex surface facing the web and disposed in contact with air flowing on the web for producing a venturi effect which reduces at least the flutter amplitude in the open draw.

19 Claims, 3 Drawing Sheets

FLUTTER SUPPRESSION AIR FOILS

FIELD OF THE INVENTION

This invention relates to the field of manufacturing web-like materials, and more particularly to methods and apparatus for reducing the amplitude of flutter associated with high speed transport of unsupported webs.

BACKGROUND OF THE INVENTION

In the manufacture of web-like products, such as paper, textiles and plastics, a web of material is typically moved along a serpentine path during the manufacturing operation. The web moving through such a path can measure several hundred feet in length and can measure a number of feet in width. Should the web break during the manufacturing process, significant down time can occur while the web is being rethreaded. Such down time can result in substantial cost to the manufacturer as well as being detrimental to product quality if breaks occur too frequently.

One major cause of breaks is flutter. Flutter is a phenomenon in which the web moves in a direction substantially perpendicular to the direction of travel, with one or more amplitudes and frequencies. Flutter in a paper machine is generally known to be caused by two components of air flow: a cross-machine-direction component caused by large volumes of ventilated air injected into pockets between dryer cans by blow boxes to reduce humidity, and a machine-direction component represented by the laminar air flow on the web as it moves through the paper machine. As the paper moves around the dryer cans, it stretches along the center of the sheet, resulting in slack at the edges of the paper where there is less tension. This slack is susceptible to vertical motion when subjected to the multiple air flow components, and flutter develops.

Artisans have employed various foil and forced air designs for use in large scale drying and web production processes, with varying results.

King, Jr., U.S. Pat. No. 4,306,358, discloses an apparatus for air drying a slurry, such as reconstituted tobacco slurry, which is conveyed on a moveable support. The apparatus includes means for directing air flow against the supported web.

Mair, U.S. Pat. No. 4,145,796, discloses the use of a current of air for flattening the bent edges of a flexible web-type work piece, such as a textile weave or knit, synthetic resin foil or paper. The air is blown from a guide in a flow direction extending transverse to the transport direction of the work piece, outwardly from the center of the work piece. This reference illustrates a pair of converging air-directing plates for ensuring that the flattened work-piece remains flat and that the flattening effect is optimized, such as to reduce curling of the edges.

Stanley, U.S. Pat. No. 3,198,499, discloses the use of an air flow to support an advancing member during heat treatment. This reference illustrates the concept of laterally flowing a gas beneath the member in a cross-machine direction.

Andrews, U.S. Pat. No. 2,574,083, discloses the use of a baffle strip for increasing a downward air pressure against an edge of a moving web which is disposed on tenter pins in a drawing chamber.

Vits, European Patent application Ser. No. 0313806 discloses a system whereby air jets are blown in a machine direction over a moving web to stabilize the web between rolls.

While, in the main, these artisans have contributed significantly to the field of web processing, they have not provided means for efficiently reducing the amplitude and frequency of flutter in modern web handling operations. Accordingly, a need exists for a flutter suppression system which includes non-contact, low energy means for reducing the flutter of a moving web in a paper machine. Such a system should be able to employ existing cross currents of air flow and, thus, minimize energy costs while reducing the number of breaks.

SUMMARY OF THE INVENTION

A method and apparatus is provided for reducing the flutter of a moving web caused by air flows. The amplitude of the flutter of the web is reduced by placing a pair of air foils proximate to, but not contacting, the planar surfaces of the web. The air foils include at least a first convex surface facing the web and positioned to contact the moving air so as to produce a venturi effect with the moving air. The venturi effect suppresses large scale eddies and air turbulence which results in lower web flutter amplitude.

Accordingly, novel means for reducing breaks and large scale flutter of paper and other web-like materials are provided by this invention. In further detailed aspects of this invention, a venturi structure is provided with the air foils for reducing eddies and air turbulence in both the cross-machine-direction and the machine-direction. The venturi structures preferably include wide gaps for receiving the cross-machine direction and machine-direction components of the air flow and for reducing the amplitude and frequency of flutter caused by these components. Supplementary air sources and heating elements incorporated into the air foil structure are disclosed for further improving drying and flutter suppression.

DETAILED DESCRIPTION OF THE INVENTION

Non-contact apparatus for reducing web-edge region flutter are provided by this invention. As used herein, the term "web-edge region" refers to a region of the web near its edges which is susceptible to flutter. The web edge region is generally not under tension and tends to "flap" in the cross currents of the open draw. The central portion of the web, alternatively, is usually subject to tension and is stretched between the dryer cans of a paper machine. Nevertheless, the flutter suppression capability of this invention is capable of operating in connection with any portion of the web.

The term "open draw" as used hereafter refers to the portion of the serpentine feed which is unsupported.

In a preferred embodiment of this invention, a pair of air foils is disposed proximate to a pair of opposing planar surfaces of the web-edge region. Each of the air foils includes at least a first convex surface facing the web and disposed in contact with the flowing air for producing a venturi effect. This effect, in turn, reduces at least the flutter amplitude in the open draws.

In another preferred embodiment of this invention, a non-contact apparatus for reducing flutter of a web in an open draw is provided. This apparatus includes a pair of air foils disposed proximate to a pair of opposing planar surfaces of the web. Each of the air foils includes first and second integral convex surfaces facing the web and disposed in contact with flowing air. The first convex surfaces form a first venturi structure having first wide and narrow gap portions. The first wide gap portion is disposed for receiving a cross-machine direction component of flowing air and the first narrow gap portion is disposed proximate to an edge of said web. Each of the air foils of this embodiment also includes a second integral convex surface forming a second venturi structure having second wide and narrow gap portions. The second wide gap portion of the second venturi structure is disposed for receiving the machine-direction component of the flowing air. The transition between the wide gap to the narrow gap should be gradual.

This invention also provides a non-contact method for reducing the amplitude and frequency of flutter of a moving web caused, in part, by flowing air over the surface of the web in an open draw. The method includes the steps of disposing a pair of air foils proximate to a pair of opposing planar surfaces of a web. Each of these air foils includes at least a first convex surface facing the web and disposed in contact with the flowing air. The method further includes producing a venturi effect with the air foils which causes a reduction of the flutter amplitude in the open draws.

Figure 1:
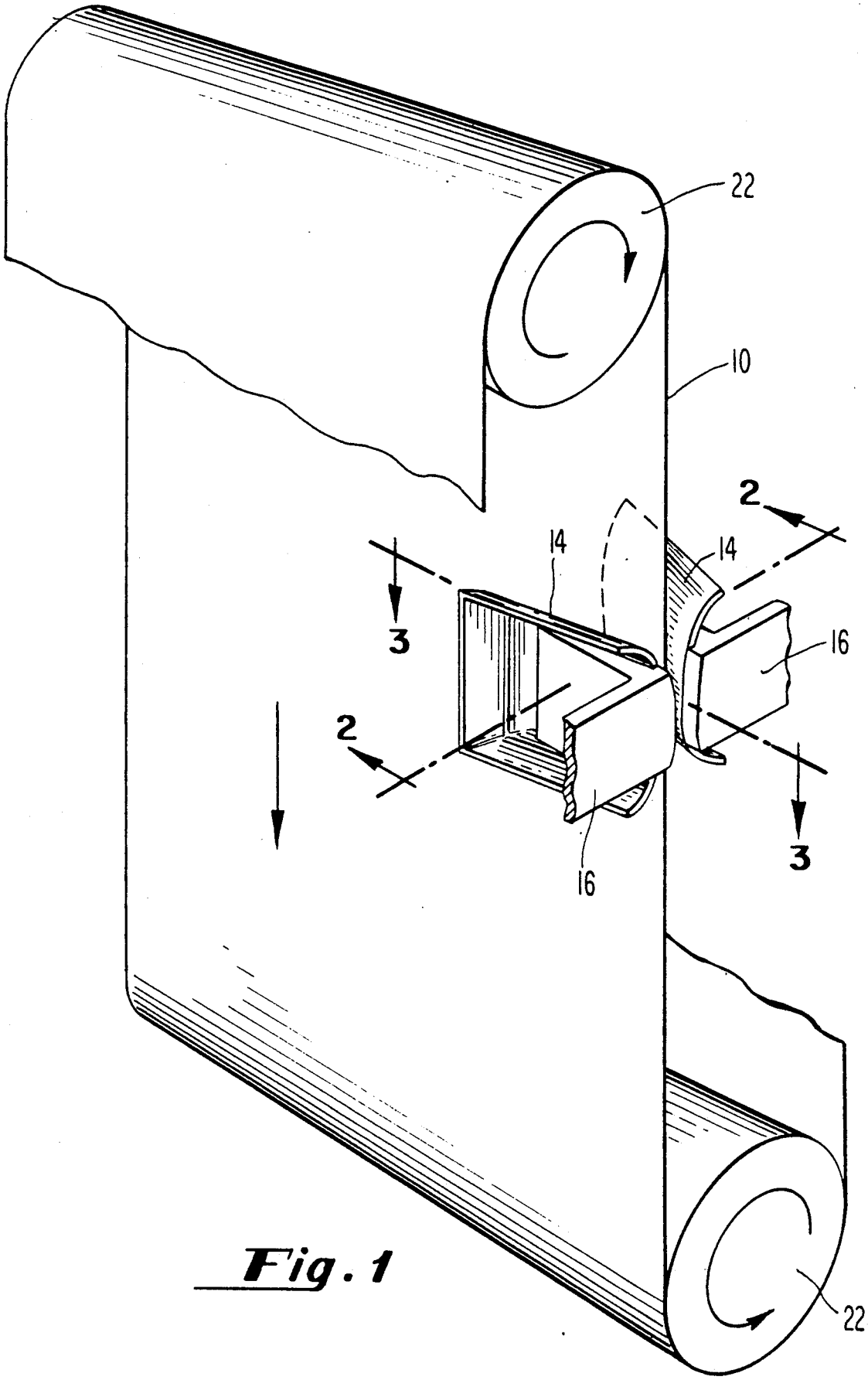
FIG. 1: is a partial perspective view of an open draw section in a paper machine, illustrating a preferred air foil arrangement disposed proximate to the edge of the paper.

Referring now to FIG. 1, there is described a preferred partial perspective view of an open draw in which a paper web 10 is drawn between two dryer cans 22. A pair of air foils 14 is disposed proximate to the edge of the web 10 and mounted to supports 16. Since low tension at the web-edge region has been determined to be a major cause of web flutter, the pair of air foils 14 disposed proximate to both sides of the web-edge streamlines air layers adjacent to web surfaces due to the venturi effect. Less turbulent flow at the constricted part of the air foils 14 dampens web-edge flutter.

Figure 2:
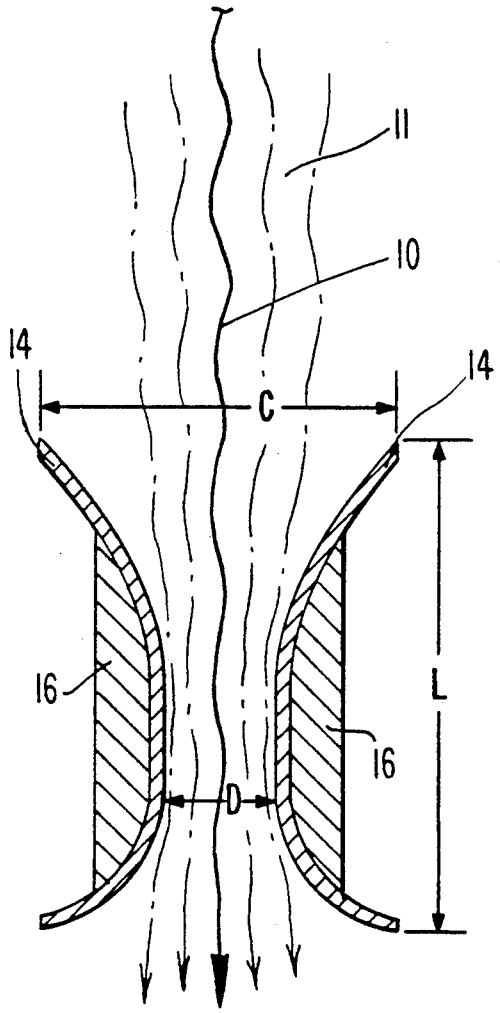
FIG. 2: is a cross-sectional view taken through line 2—2 of FIG. 1 illustrating the machine-direction contour of the air foils.

With reference to FIG. 2, there is shown a cross-sectional view looking at the preferred air foils 14 from a cross-machine direction, i.e., looking in from a transverse side of the open draw. The paper web 10 is shown with machine direction laminar air flow 11 being fed into the wide gap "C" of the machine direction venturi structure. This venturi structure is formed by the convex curvature of the air foils 14 disposed in the machine direction. This venturi structure also includes a narrow gap portion "D" for completing the venturi effect and for substantially dampening the eddies responsible for flutter in the machine direction. In the preferred embodiment, the foil length "L" can be designed to fit in the draw and preferably is less than about 12 inches. The width of the foil "W" designated in FIG. 3 preferably is between about 10–20 inches, wide gap portion "C" preferably is about 6–16 inches, and narrow gap portion "D" is preferably about 1–2 inches.

Figure 3:
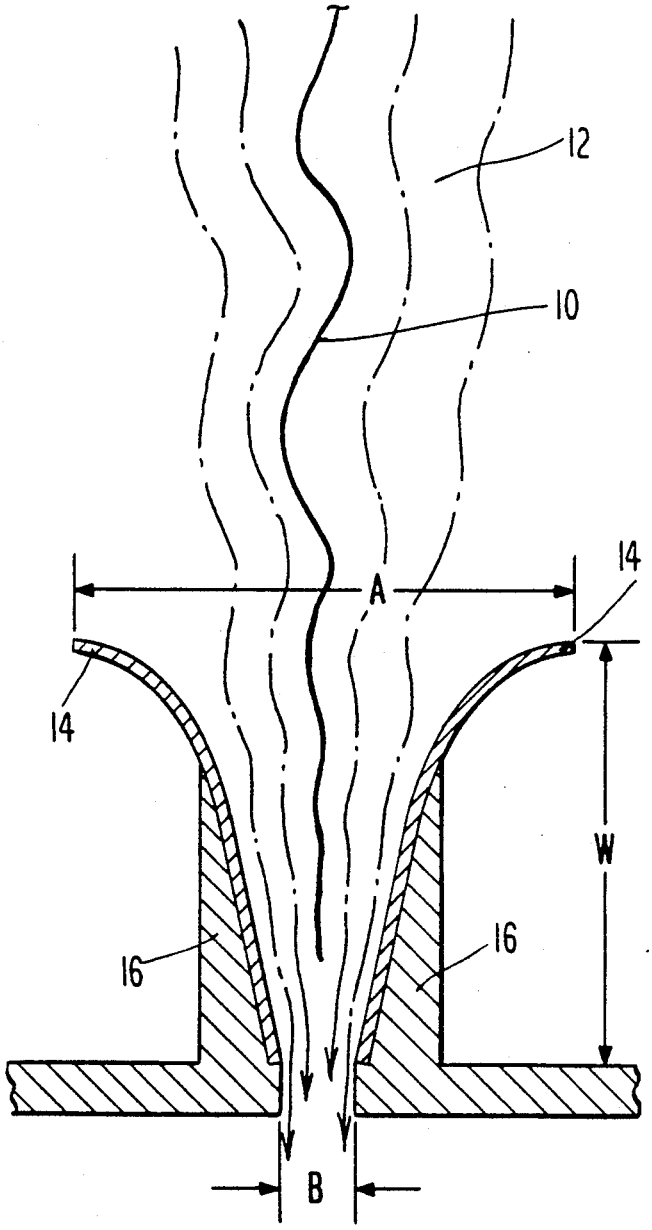
FIG. 3: is a cross-sectional view taken through line 3—3 illustrating the contour of the air foils in the cross-machine-direction.

With reference to FIG. 3, there is shown a cross-sectional view of the preferred embodiment taken through line 3—3 of FIG. 1 illustrating a view from the machine direction, i.e., looking in the same direction as the web is moving. This figure illustrates the cross-machine-direction contour and venturi structure which receives the laminar air flow 12 and ventilation air injected into the pockets between the dryer cans by blow boxes. The cross direction convex surface of each of the air foils 14 includes a wide gap portion "A" and narrow gap portion "B", preferably having the same or similar dimensions as "C" and "D" respectively. As ventilated air and laminar air 12 are entrapped between the web 10 and the foils 14, large scale eddies are suppressed gradually due to the narrowing contour of the venturi structure. The reduction in air turbulence dampens the vertical movement of the web 10, which results in lower web flutter amplitudes and frequencies. It has been concluded that air foils 14 are effective even when the cross-machine-direction component of the air flow reaches velocities of about 700–800 fpm, although their usefulness can be demonstrated at velocities of as little as 25 fpm.

Figure 4:
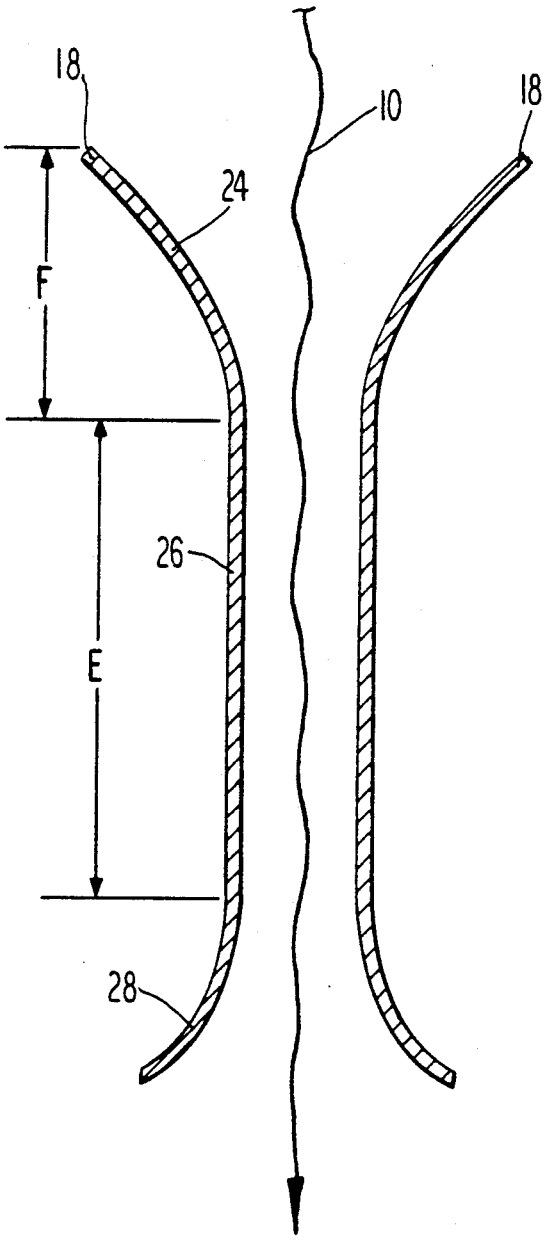
FIG. 4: is a cross-sectional view of an alternative embodiment illustrating a machine-direction contour which includes an elongated mid-foil portion and an extended leading edge for facilitating threading after a break.

Referring now to FIG. 4, there is shown an alternative embodiment of the invention having an elongated machine-direction contour. Air foil 18 has three component parts, leading edge 24 represented by dimension "F", mid-foil portion 26 represented by dimension "E", and trailing edge 28. Air foil 18 is designed for relatively long open draws, and is equipped with relatively long leading edges 24 for facilitating rethreading if a break occurs.

Figure 5:
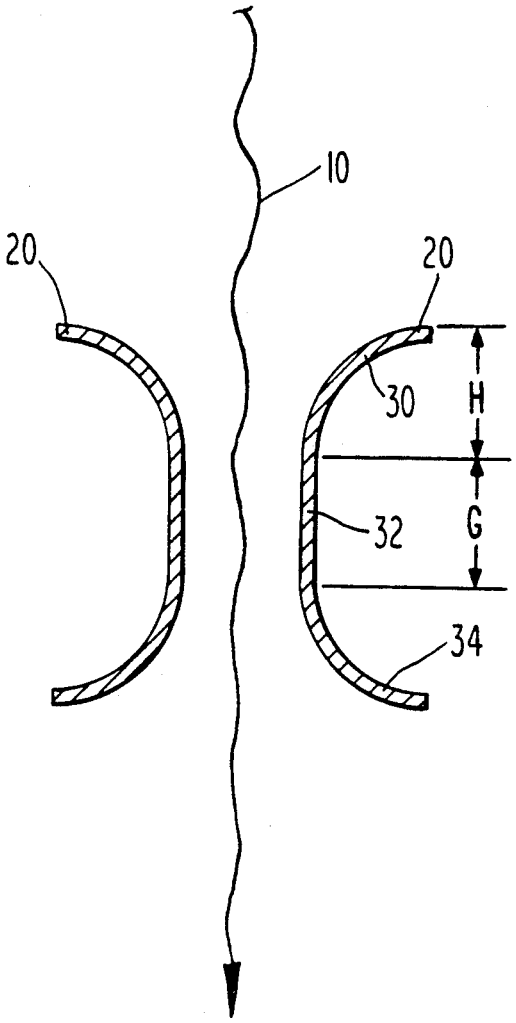
FIG. 5: is a cross-sectional view of an alternative air foil design illustrating a machine-direction contour having a mid-foil portion similar to the embodiment of FIG. 2, but not including an elongated leading edge.

Referring now to the embodiment of FIG. 5, there is shown yet another embodiment having a shorter machine-direction contour. Air foil 20 has a leading edge 30, mid-foil portion 32, and trailing edge 34. In comparison to the air foils 18 of FIG. 4, the mid-foil portion 32, represented by dimension "G", is significantly less than dimension "E" of mid-foil portion 26; thus, air foil 20 is more suitable for tighter open draws between dryer cans. This embodiment also has a shorter leading edge 30 represented by dimension "H" which provides some measure of facilitated rethreading while compensating for the tighter dryer pocket dimensions.

Experimental testing has been conducted employing a pair of convex air foils having wide gap portion dimension "A" of between about 8–10 inches, narrow gap portion dimension "B" and "D" of between about 1.5–2 inches, and a wide gap portion dimension "C" of between about 5–8 inches. The results indicate a significant dampening of air turbulence, which resulted in lower web flutter amplitudes and frequencies. At maximum cross-machine-direction air flow rates approximating 800 fpm, the flutter amplitude was reduced about 75% (from 1.5 inches to about 0.4 inches). The experimental air foils tended to dampen more selectively the high frequency flutter than the low frequency flutter. Optimization studies on air foil geometry have determined that a narrow gap "B" of about 1.5 inches between the two air foils was best suited for machine runability. A significant decrease, greater than about 50%, in flutter frequencies was also observed, with frequencies of about 7Hz for flutter occurring without any air foils to frequencies of about 2Hz with dampened flutter associated with experimental air foils.

From the foregoing, it can be determined that this invention provides means and procedures for suppressing web-edge flutter in an open draw by using air foils without web contact. The invention is particularly suitable to paper drying where excessive air flows are presently causing uncontrollable flutter in many manufacturing facilities. The air foils of this invention are also effective when draw instability is caused by mechanical disturbances such as adjusting draw fluctuation, machine frame vibration, or web non-uniformity.

The air cushion built by the entrainment air was found to be strong enough to support the web to prevent web-to-air foil contact even at machine speeds approximating 2500 fpm. The invention is applicable to papermaking and newspaper machines wherein the web is drawn up to speeds consistent with the maximum design speed of those machines.

Although various embodiments have been illustrated, this was for the purpose of describing, but not limiting the invention. Various modifications, which will become apparent to one skilled in the art, are within the scope of this invention described in the attached claims.

What is claimed is:

1. A non-contact apparatus for reducing web edge region flutter caused, in part, by flowing air on said web in an open draw in which at least a central portion of said web is stretched, said flutter including an amplitude and frequency, said apparatus comprising:

a pair of air foils disposed proximate to a pair of opposing planar surfaces of said web-edge region, each of said air foils having at least a first convex surface facing said web and disposed in contact with said flowing air for producing a venturi effect which reduces at least said flutter amplitude in said open draw.

2. The apparatus of claim 1 wherein said flowing air has a cross-machine-direction component and a machine-direction component.

3. The apparatus of claim 2 wherein said first convex surfaces form a first venturi structure having a first wide gap portion and a first narrow gap portion, said first wide gap portion disposed for receiving said cross-machine direction component of said flowing air.

4. The apparatus of claim 3 wherein said first narrow gap portion is disposed proximate to said web edge.

5. The apparatus of claim 4 wherein each of said air foils comprises a second convex surface facing said web for producing a venturi effect with said machine-direction component of said flowing air.

6. The apparatus of claim 5 wherein said second convex surfaces form a second venturi structure having a second wide gap portion and a second narrow gap portion, said second wide gap portion disposed for receiving the machine-direction component of said flowing air.

7. The apparatus of claim 6 wherein each of said first and second wide gap portions comprises a spacing of about 6–16 inches.

8. The apparatus of claim 7 wherein each of said first and second narrow gap portions comprises a spacing of about 1–6 inches.

9. A non-contact apparatus for reducing flutter of a web in an open draw caused, in part, by cross-machine-direction and machine-direction components of flowing air, whereby said flutter includes an amplitude and frequency, said apparatus comprising:

a pair of air foils disposed proximate to a pair of opposing planar surfaces of said web, each of said air foils having first and second integral convex surfaces facing said web and disposed in contact with said flowing air;

said first convex surfaces forming a first venturi structure having a first wide gap portion and a first narrow gap portion, said wide gap portion disposed for receiving said cross-machine direction component of said flowing air and said first narrow gap portion disposed proximate to an edge of said web;

said second integral convex surfaces forming a second venturi structure having a second wide gap portion and a second narrow gap portion, said second wide gap portion disposed for receiving the machine-direction component of said flowing air.

10. A non-contact method for reducing at least an amplitude of flutter of a moving web caused, in part, by flowing air over the surface of said web in an open draw, said method comprising:

disposing a pair of air foils proximate to a pair of opposing planar surfaces of said web, each of said air foils having at least a first convex surface facing said web and disposed in contact with said flowing air;

producing a venturi effect with said air foils, said venturi effect causing a reduction of said flutter amplitude in said open draw.

11. The method of claim 10 wherein said flowing air has a cross-machine-direction component and a machine-direction component.

12. The method of claim 11 wherein said cross-machine-direction component has a velocity of about 25–800 fpm.

13. The method of claim 12 further comprising reducing said flutter amplitude by at least about 50%.

14. The method of claim 13 further comprising drawing said web up to a speed consistent with the maximum design speed of papermaking and newspaper machines.

15. The method of claim 11 wherein each of said air foils has a second convex surface facing said web, said first convex surfaces forming a first venturi structure having a first wide gap portion disposed for receiving said cross-machine direction component of said flowing air and said second convex surfaces forming a second venturi structure having a second wide gap portion disposed for receiving the machine-direction component of said flowing air.

16. A non-contact apparatus for reducing web flutter caused, in part, by air flowing along the surface of a web in an open draw, wherein said web has a moisture content whereby said flutter includes an amplitude and frequency, said apparatus comprising:

a pair of air foils disposed proximate to a pair of opposing planar surfaces of said web, each of said air foils having at least a first convex surface facing said web and disposed in contact with said flowing air for producing a venturi effect for reducing at least said flutter amplitude in said open draw;

at least one of said air foils comprising reduction means for reducing said moisture content of said web.

17. The apparatus of claim 16 wherein said reduction means comprises a pressurized air nozzle.

18. The apparatus of claim 16 wherein said reduction means comprises a heating element.

19. A non-contact apparatus for reducing flutter caused, in part, by air flowing along the surface of a web in an open draw, whereby said flutter includes an amplitude and frequency, said apparatus comprising:

a pair of air foils disposed proximate to a pair of opposing planar surfaces of said web, each of said air foils having at least a first convex surface facing said web and disposed in contact with said flowing air for producing a venturi effect for reducing at least said flutter amplitude in said open draw.

* * * * *